United States Patent [19]

Wang

[11] 4,297,042

[45] Oct. 27, 1981

[54] HELICAL PRINT HEAD MECHANISM

[75] Inventor: An Wang, Lincoln, Mass.

[73] Assignee: Wang Laboratories, Inc., Lowell, Mass.

[21] Appl. No.: 154,385

[22] Filed: May 29, 1980

[51] Int. Cl.[3] ..... B41J 1/40; B41J 7/52

[52] U.S. Cl. ..... 400/163.2; 400/165

[58] Field of Search ..... 400/164, 163.1, 165, 400/163, 161.1, 162, 163.2; 101/93.23

[56] References Cited

U.S. PATENT DOCUMENTS

| | | | |
|---|---|---|---|
| 447,720 | 3/1891 | Wilder | 400/165 |
| 548,726 | 10/1895 | Seifried | 400/165 |
| 734,044 | 7/1903 | Cantelo | 400/165 |
| 752,795 | 2/1904 | Moya | 400/165 X |
| 2,892,031 | 6/1959 | Arko et al. | 400/162 X |
| 3,085,670 | 4/1963 | Paige | 400/165 X |
| 3,739,897 | 6/1973 | Pateuk et al. | 400/163.1 X |

FOREIGN PATENT DOCUMENTS

| | | | |
|---|---|---|---|
| 9774 | of 1908 | United Kingdom | 400/165.1 |

*Primary Examiner*—Paul T. Sewell

[57] ABSTRACT

An impact printer head mechanism for printing on a print medium has a cylindrical print head with its axis perpendicular to the print line and a matrix of characters on its exterior surface in the form of a multi-turn helical row. A rotatably fixed screw thread cooperating with an internal screw thread on the print head is provided for supporting the print head for rotational and axial movement. A print head drive, including a gear cooperating with a spline on the print head, is provided for rotating the print head to simultaneously rotatably and axially move it to position a desired character relative to the print line. Operating means is provided for moving the print head relatively to the printing medium to cause a selected character to be printed.

4 Claims, 3 Drawing Figures

HELICAL PRINT HEAD MECHANISM

This invention relates to impact printers and, more particularly, to printer head mechanisms for such printers.

Printer head mechanisms of the cylindrical head type having a plurality of axially spaced rows of characters have long been known, and are shown and described, for example, in U.S. Pat. Nos. 3,739,898; 3,743,073 and 4,036,349. However, the operating mechanisms of such heads tend to be unduly mechanically complicated because of the necessity for moving their cylindrical printer head axially in a direction perpendicular to the printing line as well as rotating it in order to position a desired character relative to the print line.

Printer head mechanisms of the well-known IBM "Selectric" type, although widely used, are even more complicated.

These mechanically complicated mechanisms are not only expensive to manufacture, but also have a relatively high failure rate and are difficult to maintain, particularly with relatively high speed printers used as computer and word processor output printers.

It is a major object of the present invention to provide an impact printer having a novel cylindrical head mechanism which is mechanically simpler than heretofore known mechanisms and so is less expensive to manufacture, more reliable, and easier to maintain.

This has been accomplished according to the present invention by the provision of an impact printer head mechanism for serially printing a line of characters on a print medium comprising a generally cylindrical print head having its axis generally perpendicular to the print line with a matrix of characters in a multi-turn helical row, a print head supporting means for supporting the print head for rotational and axial movement relative to the print medium, print head drive means for simultaneously rotatably and axially moving the print head to position a desired character relative to the print line and operating means for operating the mechanism to cause a selected character to be printed on the printing medium.

The print head with its matrix of characters formed on its exterior surface in a multi-turn helical row of predetermined pitch has a screw thread of the same predetermined pitch coaxial with the axis and a spline coaxial with the axis and axially spaced from the matrix. The print head supporting means has a rotatably fixed screw thread of the same predetermined pitch cooperating with the print head screw thread. The print head drive means includes gear means cooperating with the spline for rotating the print head, the relative rotation of the screw threads of the print head and the supporting means producing simultaneous rotational and axial movement of the print head relatively to the print line.

In preferred embodiments, the printer head mechanism of the invention further includes mounting means mounting the supporting means for limited swinging movement toward and away from the print medium, comprising pivotally mounted lever means extending generally perpendicular to said axis, and actuating means for actuating the mounting means by pivotally moving the lever to cause a selected character to be printed.

For the purpose of fully explaining the invention, reference is now made to the following detailed description of a preferred embodiment thereof, taken together with the accompanying drawings, wherein.

Figure 1:
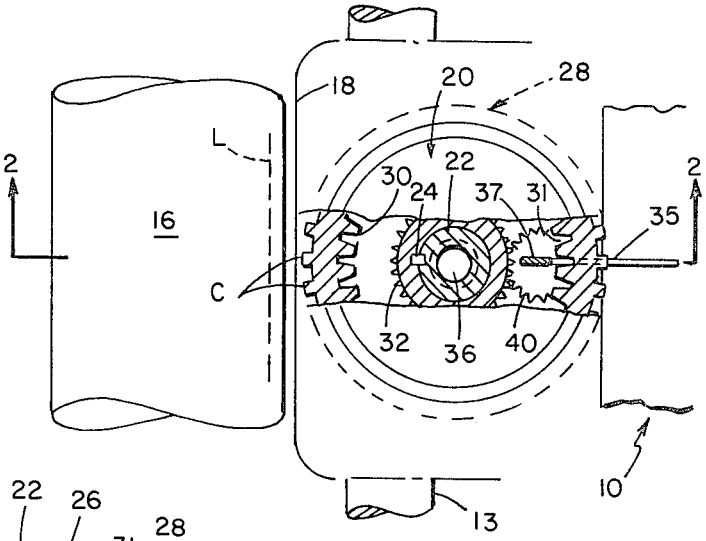
FIG. 1 is a partial top view of an impact printer showing the novel head mechanism of the present invention.
Figure 2:
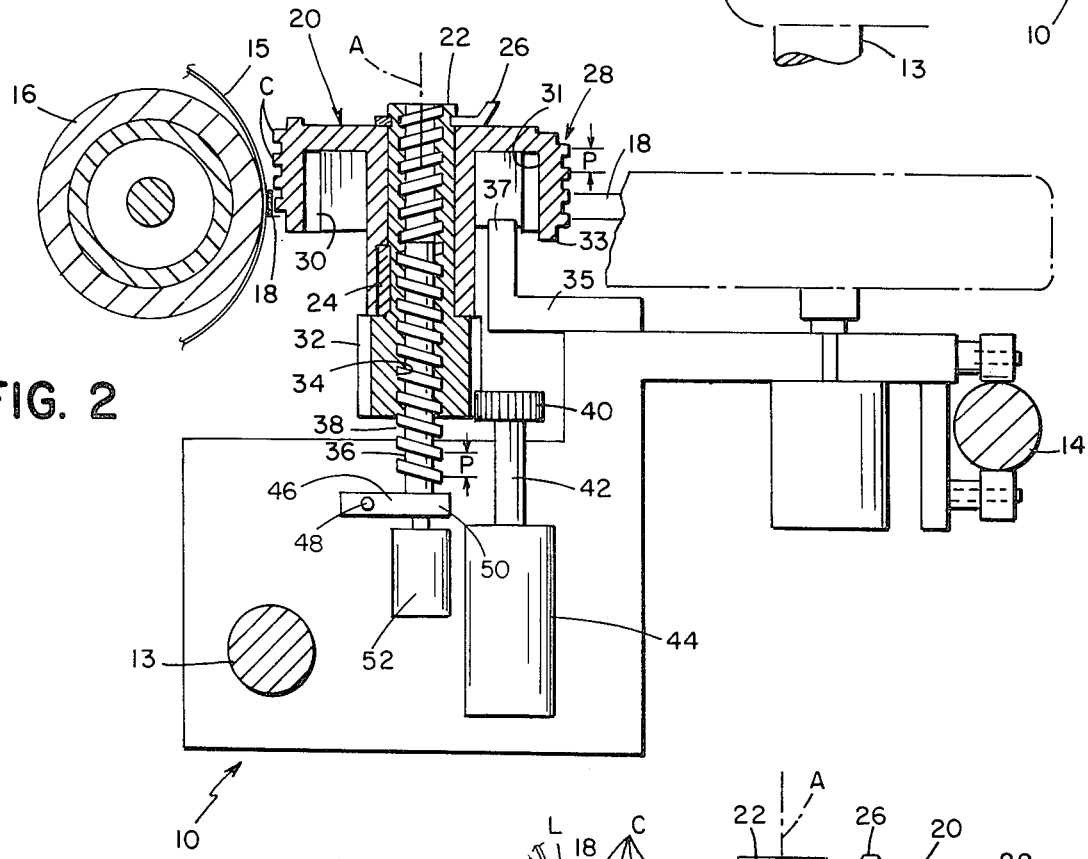
FIG. 2 is a side sectional view, taken on line 2—2 of FIG. 1, of the head mechanism of FIG. 1.
Figure 3:
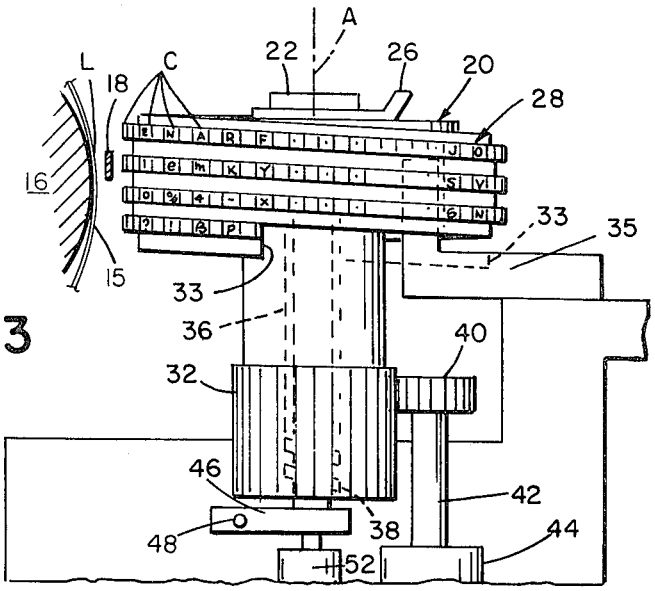
FIG. 3 is a partial side view of the head mechanism of FIGS. 1 and 2.

Referring to the drawings, the impact printer head mechanism of the present invention is mounted on carriage 10 supported in the usual manner on a pair of guide rods 13 and 14 and driven therealong by suitable means well known in the art for serially printing a line L of characters on a print medium, such as paper 15 supported on a conventional platen 16, using a conventional ribbon 18.

A generally cylindrical print head 20 of inverted cup shape at its upper end, with its axis A generally vertical and perpendicular to print line L, is removably mounted on the upper end of head shaft 22 by key 24 and snap ring 26. Print head 20 has a matrix of characters C formed on its exterior surface coaxial with axis A in a multi-turn helical row 28 of predetermined pitch P (number of threads per unit of axial length). On its interior surface it has an internal spline 30, also coaxial with axis A, providing alignment detents 31 for characters C and on its bottom edge an abutment 33 cooperating with a stop member 35 mounted on carriage 10 for defining the initial position of print head 20. The upper free end 37 of stop member 35 cooperates with the alignment detent 31 of a selected character C. Head shaft 22, on its lower end, has an internal screw thread 34 of the same predetermined pitch P coaxial with axis A. Head shaft 22 also has on its lower end, coaxial with axis A and axially spaced below print head 20, an external driving spline 32.

For supporting print head 20 and its shaft 22 for rotational and axial movement relative to print line L, print head supporting means is provided in the form of a rotatably fixed post 36 having an external screw thread 38 coaxial with axis A and of the same predetermined pitch P for cooperating with internal screw thread 34 of print head shaft 22.

For simultaneously rotatably and axially moving print head 20 and its shaft 22 to position a desired character C relative to print line L, print head drive means is provided in the form of gear 40, mounted on vertical shaft 42 and driven by positioning motor 44. Gear 40 cooperates with driving spline 32 for rotating print head 20 and its shaft 22, the relative rotation of screw threads 34 and 38 of print head shaft 22 and fixed post 36 producing simultaneous rotational and axial movement of print head 20 relatively to print line L.

Mounting means is provided for mounting fixed post 36 for limited swinging movement for printing movement of print head 20 toward and away from paper 15. It comprises lever 46, pivotally mounted on carriage 10 by pivot pin 48. Lever 46 extends generally perpendicular to axis A and has post 36 mounted on its free end 50. Actuating means for actuating printing movement of print head 20 by pivotally moving lever 46 to cause a selected character C to be printed on paper 15 is provided by a suitable solenoid 52 mounted on carriage 10 for moving lever 46 vertically upwardly to cause generally horizontal printing movement of print head 20.

In operation, assuming that printer head 20 has been assembled with proper alignment as defined by abutment 33 and stop member 35, positioning motor 44 is stepped to a desired position. This causes printer head 20 simultaneously to rotate and move axially to position a desired character C opposite print line L. Solenoid 52 is then energized to swing lever 46 upwardly and consequently printer head 20 horizontally so that the selected character C is caused to be printed on print line L of paper 15 through ribbon 18. During this printing motion, printer head 20 is maintained in alignment by the engagement of a selected detent 31 with fixed upper free end 37 of stop member 35. After printing, solenoid 52 is deenergized in preparation for selecting the next desired character C to be printed on line L.

I claim:

1. An impact printer head mechanism for serially printing a line of characters on a print medium comprising a generally cylindrical print head having its axis generally perpendicular to said print line said print head having a matrix of characters formed on its exterior surface parallel to said axis in a multi-turn helical row of predetermined pitch a screw thread of said predetermined pitch and coaxial with said axis, and a spline coaxial with said axis and axially spaced from said matrix print head supporting means for supporting said print head for rotational and axial movement relative to said print medium, said print head supporting means having a rotatably fixed screw thread coaxial with said axis and of said predetermined pitch cooperating with said print head screw thread, and print head drive means for simultaneously rotatably and axially moving said print head to position a desired character relative to said print line, including gear means cooperating with said spline for rotating said print head, the relative rotation of said screw threads of said print head and said supporting means producing simultaneous rotational and axial movement of said print head relatively to said print line, and operating means for operating said mechanism to cause a selected character to be printed on said print medium.

2. A mechanism as claimed in claim 1, wherein said operating means includes mounting means mounting said supporting means for limited movement toward and away from said print medium, and actuating means for actuating said mounting means to cause a selected character to be printed on said print medium.

3. A mechanism as claimed in claim 1, wherein said mounting means comprises pivotally mounted lever means, extending generally perpendicular to said axis, mounting said supporting means for limited swinging movement toward and away from said print medium, and said actuating means actuates said mounting means by pivotally moving said lever to cause a selected character to be printed on said print medium.

4. An impact printer head mechanism for serially printing a line of characters on a print medium comprising a generally cylindrical print head having its axis generally perpendicular to said print line said print head having a matrix of characters formed on its exterior surface parallel to said axis in a multi-turn helical row of predetermined pitch an internal screw thread of said predetermined pitch and coaxial with said axis, and an external spline coaxial with said axis and axially spaced from said matrix print head supporting means for supporting said print head for rotational and axial movement relative to said print medium, said print head supporting means having a rotatably fixed external screw thread coaxial with said axis and of said predetermined pitch cooperating with said print head internal screw thread print head drive means for simultaneously rotatably and axially moving said print head to position a desired character relative to said print line, including gear means cooperating with said spline for rotating said print head, the relative rotation of said screw threads of said print head and said supporting means producing simultaneous rotational and axial movement of said print head relatively to said print line mounting means mounting said supporting means for limited swinging movement toward and away from said print medium, comprising pivotally mounted lever means extending generally perpendicular to said axis, and actuating means for actuating said mounting means by pivotally moving said lever to cause a selected character to be printed on said print medium.

* * * * *